United States Patent [19]

Fukushima

[11] Patent Number: 4,748,692

[45] Date of Patent: Jun. 7, 1988

[54] NECKTIE

[76] Inventor: Shizuo Fukushima, 2-1, Higashi 3-chome, Hounan-cho, Toyonaka-shi, Osaka-fu, Japan

[21] Appl. No.: 4,724

[22] Filed: Jan. 20, 1987

[30] Foreign Application Priority Data

Jan. 29, 1986 [JP] Japan ..... 61-12343[U]

[51] Int. Cl.[4] ..... A41D 25/08

[52] U.S. Cl. ..... 2/152 R; 2/153; 2/150

[58] Field of Search ..... 2/152 R, 152 A, 153, 2/148, 149, 150, 151

[56] References Cited

U.S. PATENT DOCUMENTS 1,968,401 7/1934 Kapfer ..... 2/150
2,617,108 11/1952 Anzell ..... 2/153
2,898,600 8/1959 Lipes et al. ..... 2/150
3,964,105 6/1976 Gideon ..... 2/152 R
3,999,222 12/1976 Walborn ..... 2/150

FOREIGN PATENT DOCUMENTS 521666 3/1955 Italy ..... 2/150

*Primary Examiner*—Louis K. Rimrodt
*Assistant Examiner*—J. L. Olds
*Attorney, Agent, or Firm*—Jones, Tullar & Cooper

[57] ABSTRACT

This invention discloses a necktie, in which a knot shaped tying member is provided separately from a necktie main body, and a rear side of the tying member is divided into right and left sides so that the necktie main body may be inserted between the divided end sections, and in which after the insertion, an engaging member provided at one end of the divided end sections of the tying member is engaged with a hook provided at another end, thereby a clearance between the divided end sections is closed.

5 Claims, 4 Drawing Sheets

NECKTIE

BACKGROUND OF THE INVENTION

1. Field of the Invention:

This invention relates to a necktie.

2. Prior Art:

Hitherto, neckties have been prepared by sewing a cloth, etc. into a belt-like form. When putting on a necktie, the intermediate section is put below the collar of a cutter shirt and the portions extending out of the collar are tied in a peculiar tying way so that an inverted cone-shaped knot may be formed.

However, a problem exists in that it is troublesome to tie the necktie in such tying way, and moreover, when the conventional necktie is tied in the above way, the portions extending from the knot bear easily the wrinkle and often fail to have a clear-cut appearance. Furthermore, when it is hot or when a user of the necktie wishes to relax himself and pulls down the knot, the knot is not loosened but tightened.

What is more, the tied section of a necktie is always substantially the same portion. Accordingly, even after the necktie is untied, the wrinkle still remains in that portion and therefore the portion is apt to become soiled and dirty. If it gets dirty, the whole necktie has to be cleaned, which is quite inconvenient.

SUMMARY OF THE INVENTION

In view of the above-discussed problems, it is an object of this invention to provide a novel necktie comprising a belt-like main body and an inverted cone-cylindrical tying member, and which is easy to apply and remove by simply attaching or detaching the tying member to and from the main body, neat and pretty in applied appearance, easy to release, and wrinkle or dirt being hardly formed on the main body.

The foregoing object of the invention is accomplished by providing a necktie comprising a belt-like main body, a tying member of which the front view is an inverted cone-cylindrical shape with its backside divided into left and right sections, and into which the necktie is inserted, an engaging member provided at one end of the divided section of the tying body, a hook provided at the other end of the divided section of the tying body which is detachable to the engaging member, a holding section provided on the upper side of the engaging member so that the backside of the main body inserted into the tying member is supported when engaging the engaging member with the hook, and a pressing section provided on the lower side of the engaging member so that the main body is elastically pressed on the tying body.

DETAILED DESCRIPTION OF THE PREFERRED EMBODIMENTS

Figure 1:
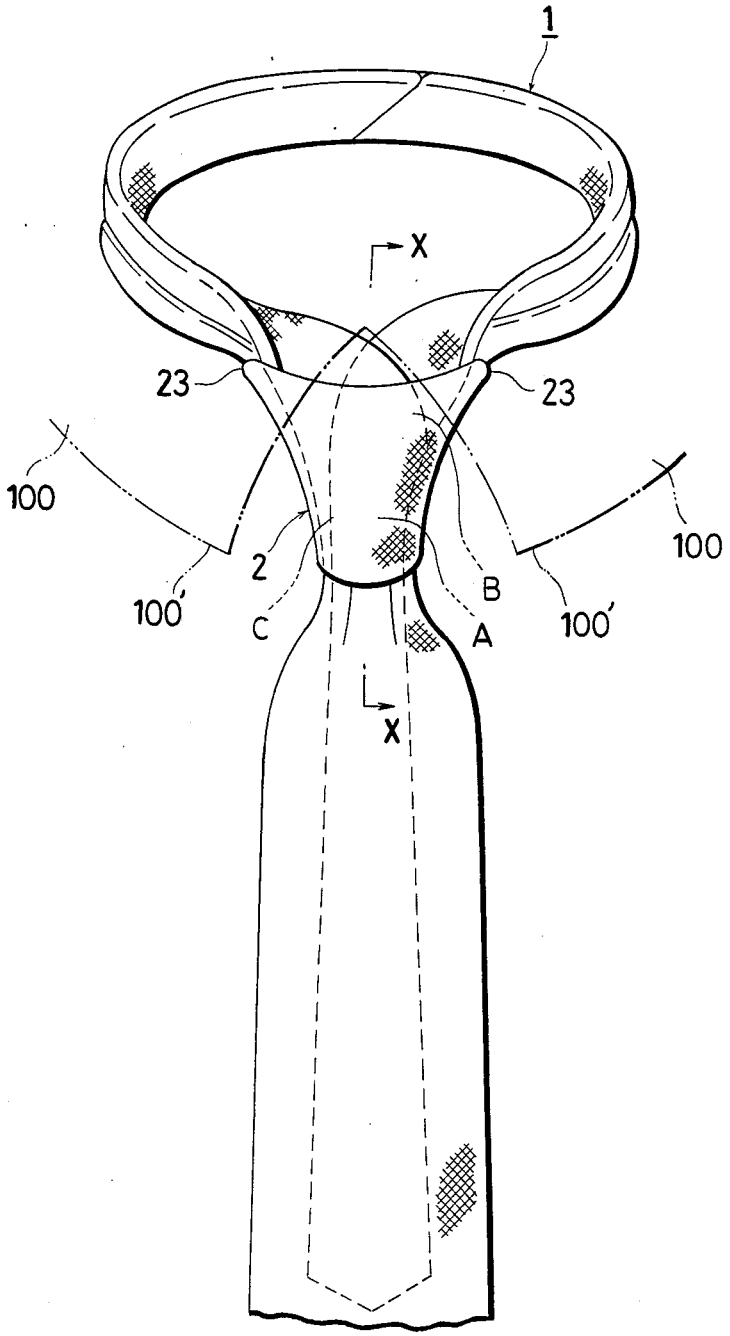
FIG. 1 is a front view showing an embodiment of this invention.

FIGS. 1 to 6 show an embodiment of the necktie according to this invention. In this embodiment, as illustrated in FIG. 1, a necktie is composed of a necktie main body 1 prepared by sewing a cloth into a belt-like form, and a tying member 2 of inverted cone-cylindrical knot shape into which the above main body 1 can be inserted.

The shape of the necktie body 1 may be of any form so long as it is belt-like.

For example, the intermediate section thereof may be made narrower in width while the width being made larger toward the ends from the narrower intermediate section. Furthermore, one end thereof may be made wider than the other end.

Figure 2:
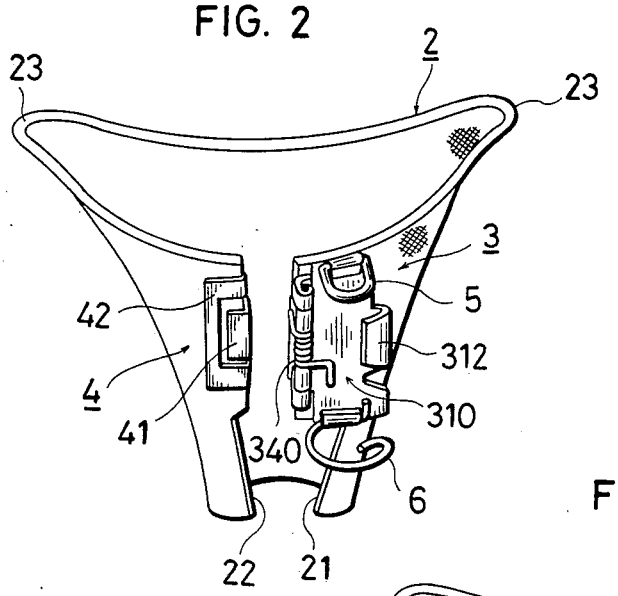
FIG. 2 is a perspective view showing the rear side of the tying body when an engaging member is opened.
Figure 3:
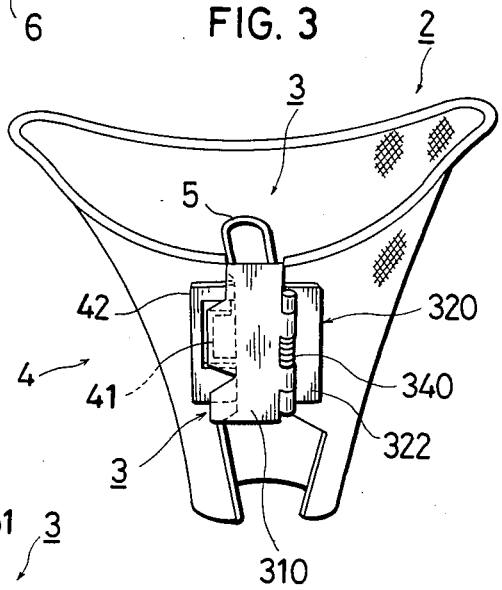
FIG. 3 is a perspective view showing the rear side of the tying body when the engaging member is closed.

As shown in FIGS. 1 to 3, the tying member 2 is an inverted cone-cylinder. Such a tying member 2 may be made, for example, of plastic material, elastic thin plate or the like serving as a core material, on which a cloth is lined, and the tying member possesses an elasticity by itself.

The back side of the tying body 2 is divided into right and left sections. Between one divided end section 21 and the other divided end section 22, a space is formed to permit insertion of the main body 1 thereinto.

Furthermore, the divided end section 21 is provided with an engaging member 3, while the other divided end section 22 is provided with a hook 4 so that the engaging member 3 may be engaged and/or disengaged from the hook 4, as shown in FIGS. 2 and 3.

Figure 4:
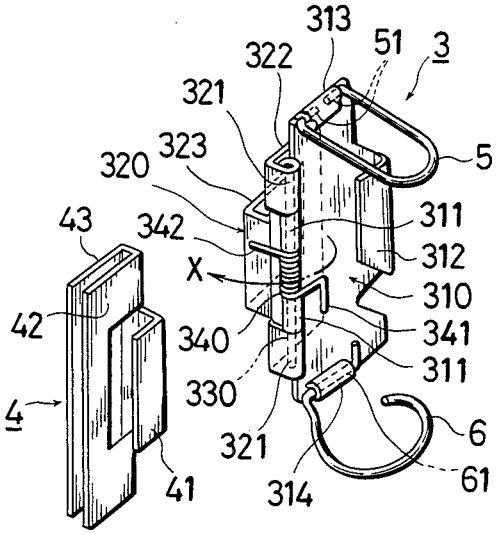
FIG. 4 is a perspective view showing the engaging member and a hook.

As shown in FIG. 4, the engaging member 3 consists of an engaging member main body 310 which is prepared by processing a metal plate, and a fitting section 320 to the tying member 2. The engaging member main body 310 and the fitting section 320 are turnably joined together by way of a shaft 330.

That is to say, the above engaging member main body 310 and the fitting section 320 are vertically provided with a pair of cylindrical sections 311, 311 and another pair of cylindrical sections 321, 321 respectively. The cylindrical sections 311, 311 are arranged between the cylindrical sections 321, 321 so as to be co-axially superposed.

The shaft 330 passes through the cylindrical sections 321, 311, 311 and 321 so that the engaging member main body 310 and the fitting section 320 are turnably joined together. In addition, the shaft 330 is externally fitted with a winding spring 340 at the position between the cylindrical sections 311, 311, and when this twisting spring 340 is oscilated in the direction of closing the engaging member body 310 (i.e., in the direction of the arrow X in the drawing), one end 341 thereof comes in contact with the engaging member body 310 while the other end 342 comes in contact with the fitting section 320, and thereby energizes the engaging member body 310 in the direction to be opened.

Figure 5:
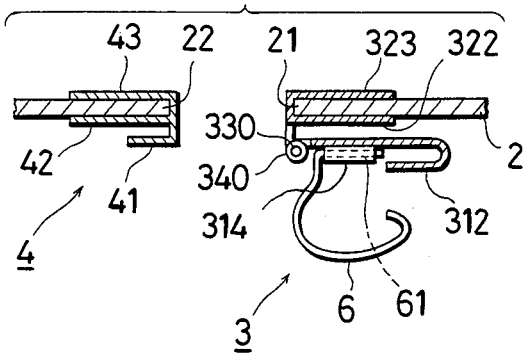
FIG. 5 is a cross sectional view of FIG. 2.

The above engaging member main body 310 has a hook-shaped setting section 312 on the opposite side of the end portion where the above cylindrical sections 311, 311 are formed. As shown in FIG. 5, the fitting section 320 is provided with a pair of protruding pieces 322, 323. By securely inserting the divided end section 21 of the tying member 2 to a position between the protruding pieces 322, 323, the above engaging member 3 is fixed to the tying member 2.

The hook 4 is also prepared by processing a metal plate and, as shown in FIG. 4 and FIG. 5, is solidly provided with a hook body 41 to be engaged with an engaging section 312 formed on the engaging member body 310, and a pair of protruding pieces 42, 43. By inserting the protruding pieces 42, 43 into the divided end section 22 of the tying member 2, as shown in FIG. 5, the hook is engagedly fixed to the tying body 2.

The engaging member 3 is provided with a supporting section 5 which supports the upper back side of the necktie main body 1 superposingly fitted to the tying member 2, and a pressing section 6 which presses elastically the necktie main body 1 against the tying member 2.

The supporting section 5 is formed by bending an elastic steel wire into approximate U shape. The root section 51 on the open end side bent inward is wound with a protruding piece 313 formed at the upper end of the engaging member body 310, thus being fixed to the engaging member 3.

The pressing section 6 is also composed of a steel wire with elasticity and is substantially formed into a ring shape, with its end free. A linear section 61 at the other end is wound with a protruding piece 314 which is formed at the lower end of the above engaging member body 310, thus being fixed to the engaging member 3.

Figure 6:
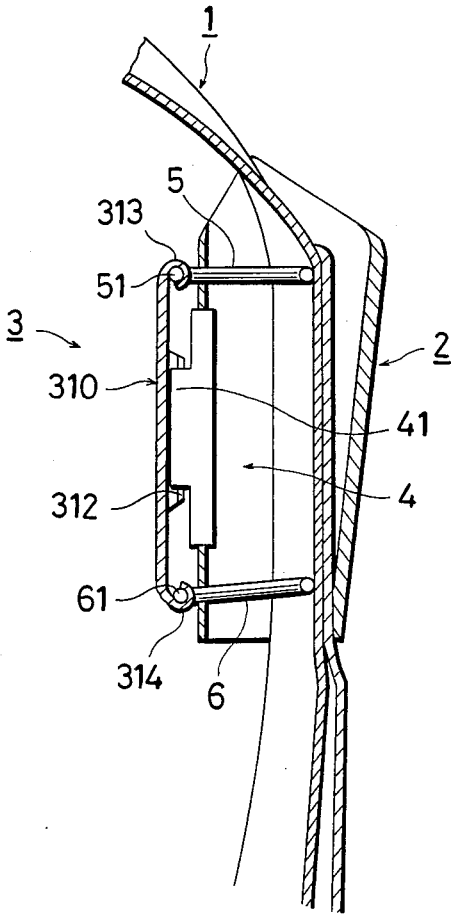
FIG. 6 is a sectional view taken along the line X—X of FIG. 1.

When putting on the necktie which is prepared as described above, the intermediate section of the main body is set in reverse and is put under the collar of the cutter shirt. At the same time, the sections B and C which come out of the collar are twisted and superposed in such a way that the top side may appear in the front. The superposed section A is passed through the clearance between the divided end sections 21, 22 at the rear side of the tying member 2, as shown in FIGS. 1 and 6, and is fixed into the tying member 2. At this time, the thumb of the left hand is used to push the tying member 2 into the superposed section A, thus this overlapped section A is fitted to the tying member 2.

Then, the tying member 2 is held with the left hand and the clearance between the divided end section 21 and the other divided end section 22 is narrowed and, under this condition, the engaging member 3 is swayed in the direction of the arrow X in FIG. 4, this fitting section 33 being fitted to the hook 4.

In this way, as shown in FIG. 6, the supporting section 31 and the pressing section 32 of the engaging member 3 are fitted inside the tying member 2. Then, the upper rear side of the above superposed section A of the main body, which is inserted in the tying member 2, is backed up with the supporting body 31. Hence, no large space is formed between the upper section of the tying member 2 and the necktie main body 1.

Furthermore, the lower section of the above superposed section A is pressed elastically against the tying member 2 by the pressing section 32.

Thereafter, the tying member 2 is slid upward along the necktie main body 1. As shown in FIG. 1, the protruding sections 23, 23 formed on the right and left of the tying member 2 are then moved under the collar edges 100', 100' at the right and left of the cutter shirt 100, so as not to be seen from the front.

In the above embodiment, all or a part of the engaging member body 310, fitting section 320 of the engaging member 3 and the hook 4 may be made of synthetic resin or other material. The material of the supporting section 5 and pressing section 6 can be also replaced with other material.

The twist screw 340 is not always necessary. However, so long as the twist screw 340 is provided and the engaging member body 310 is kept energized always in the opening direction when it is set at the hook, the clearance between the divided ends 21, 22 is narrowed in spite of the elasticity of the tying member 2. Accordingly, the locking section 312 of the locking mbember body 310 is easily released from the hook body 41. By the energizing force of the twist spring 340, the engaging member body 310 is promptly returned from the locked stated shown in FIG. 3 to the released stated in FIG. 2, thus opening the clearance between the divided ends 21, 22. In this way, it can be used more conveniently and easily.

Figure 7:
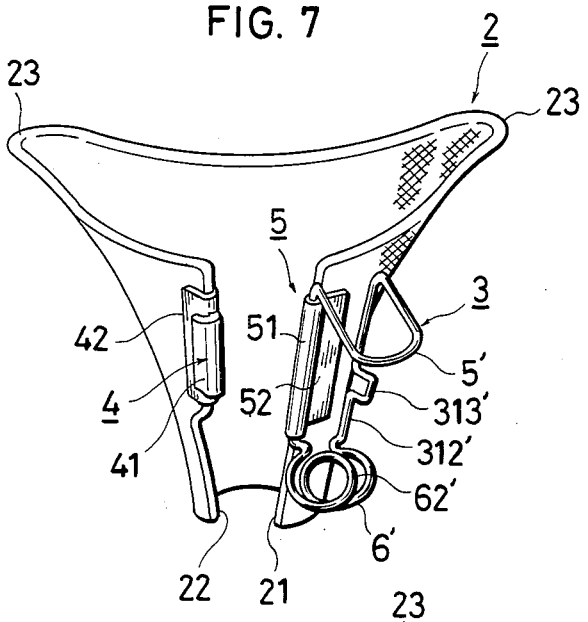
FIG. 7 is a perspective view of the rear side the tying body when the engaging member is opened according to another embodiment of this invention.
Figure 8:
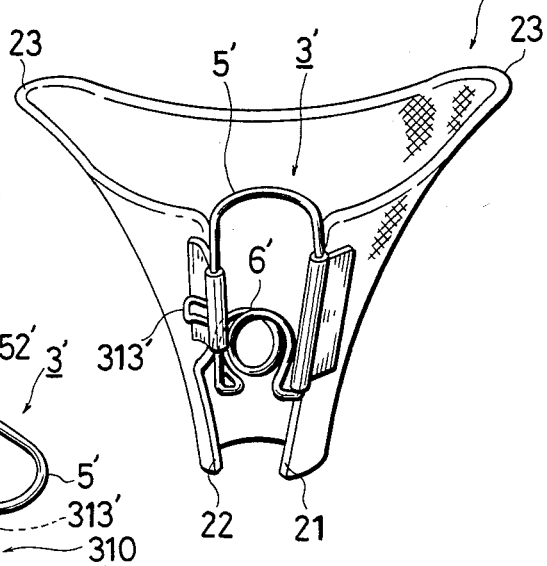
FIG. 8 is a perspective view of the rear side of the tying body shown in FIG. 7 when the holding device is closed.

Another embodiment example of this invention is now described with reference to FIGS. 7 to 9.

This embodiment differs from the necktie of the preceding embodiment shown in FIGS. 2 to 6, mainly in the shape of the engaging member 3, and the supporting section 5 and pressing section 6 provided on this engaging member 3.

Figure 9:
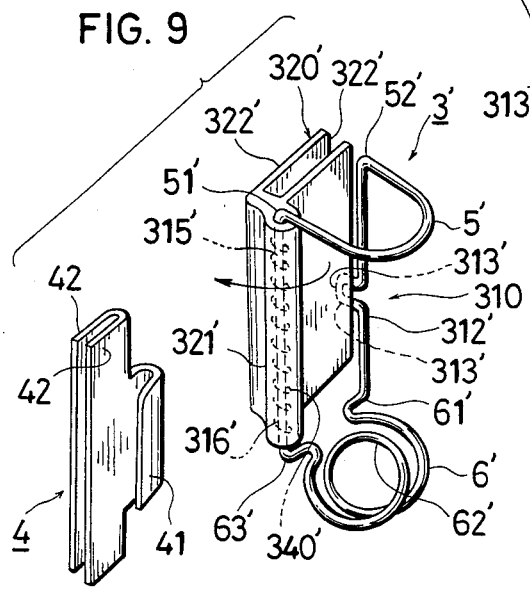
FIG. 9 is a perspective view of the holding device and hook of FIG. 7.

That is to say, as shown in FIG. 9, among the engaging member body 310' and fitting section 320' forming the engaging member 3' of the necktie of this embodiment, the engaging member body 310' as well as the supporting section 5' and pressing section 6' is formed by bending a steel wire.

Namely, a steel wire is inserted from the upper end of the cylindrical section 321' forming the fitting section 320' into this cylindrical section 321'. Thus, a shaft core 315' forming the engaging member body 310' is arranged, which, at the same time, forms the U-shaped supporting section 5', using the above upper end as a base end 51'.

From a terminal end 52' of this supporting section 5', the engaging section 312' forming the engaging member body 310' is vertically arranged. Then, by using the lower end of this engaging section 312' as a base end 61', the pressing section 6' is formed in which a terminal end 63' is located at the lower end of the cylindrical section 321', while forming the loop 62' in the half way. From the end 63', a steel wire is inserted into the cylindrical section 321' as a shaft core 316' forming the engaging member body 310'. The intermediate section of the setting section 312' is equipped with a handle 313'.

As described above, a steel wire integrally forms the engaging member body 310' comprising the shaft cores 315', 316' and the engaging section 312', as well as the supporting section 5' and the pressing section 6'. A spring 340' is provided between the engaging member body 310' and fitting body 310'. By means of this spring 340', the engaging member body 310' is always kept energized in the opening direction. By snapping the handle 313' with a finger, the engaging section 312' of the engaging member body 310' engaged with the hook 4 is released from the hook 4. Then, being energized by the spring 340', the engaging member body 310' is immediately returned from the state of FIG. 8 to the state of FIG. 7, thereby the clearance between the divided end sections 21, 22 is opened, which enables easy use of the necktie.

As shown in the pressing section 6' of this embodiment, if a loop 62' is formed halfway so that the base end 61' and terminal end 63' are fixed in this pressing section, the elastic deformation width can be adjusted by reducing or enlarging the loop 62' so as to be adaptable to the necktie with larger or smaller width.

The pressing section with such a formation of the loop 62' can be also adopted in place of the pressing section 6 of the embodiment shown in FIGS. 1 to 5.

As has been described so far, the necktie according to this invention can be simply worn by superposing the intermediate section of the necktie main body and inserting the superposed section into the tying body, while engaging the engaging member with the hook, and rather troublesome work of trying a necktie in the conventional way being omitted.

Nevertheless, a knot is formed with the tying body in such a manner that the knot is always kept neat and wrinkle-free condition. Furthermore, by concealing the right and left upper end portions of the tying member under the cutter shirt collar edges, there appears no difference from the case of a conventional necktie. Moreover, an advantage is insured by the necktie of this invention in that it appears more pretty than the conventional necktie since no wrinkle is formed at the knot.

By simply pulling down the tying member, the necktie can be easily loosened. Furthermore, it is not necessary to bind the necktie main body. Therefore, the necktie main body is scarcely soiled, and it is the tying member only that gets dirty. Consequently, it is satisfiable that only the tying member is washed and the washing can be done simply.

What is more, according to this invention, the necktie main body needs not be tied in the conventional way and the length of necktie main body can be shortened in comparison with the conventilnal necktie, thus the amount of cloth being saved.

If various sizes to tying members are prepared, a large knot or small knot can be freely prepared by selecting one of them according to the preference. When various colours and patterns are applied to the tying body, the knot of the same colour with the necktie main body or of different colour or pattern from the necktie main body can be arranged freely according to the preference, which is a further advantage.

What is claimed is:

1. A necktie, comprising:

a belt-like body; and an elastic tying member having an inverted cone-cylindrical shape with a frontside and a backside, said backside being divided into left and right sections separated by a clearance, and into which said belt-like main body is inserted, said tying member comprising:

an engaging member provided at one end of the divided section of said tying member, said engaging member having an upper end and a lower side; and a hook provided at the other end of the divided section of said tying member and which is detachable to said engaging member, said engaging member including:

a supporting section provided on the upper side of said engaging member so that the backside of the belt-like main body inserted into said typing member is supported when engaging said engaging member with said hook, said supporting section comprising a projecting piece a pressing section comprising steel wire having elasticity, said pressing section being provided on the lower side of said engaging member so that the belt-like main body is elastically pressed against said tying member;

a fitting section for fitting to said tying member;

an engaging member body rotatably connected to said fitting section and engageable with said hook;

a shaft for rotatably connecting the fitting section and the engaging member body; and a winding spring mounted to said shaft and engageable with said fitting section and said engaging member body, wherein:

the engagement of the engaging member body and the hook is achieved by narrowing the clearance between the divided sections and overcoming the elasticity of the tying member; and the engaging member body is biased open away from said hook by said winding spring when the engagement of the engaging member body to the hook is released.

2. A necktie according to claim 1, in which said engaging member body is formed of a plate-like material.

3. A necktie according to claim 2, in which said engaging member body is formed of a metal plate.

4. A necktie according to claim 2, in which said engaging member body is formed of the synthetic resin plate.

5. A necktie according to claim 1, in which said engaging member body is formed of steel wire.

* * * * *